US006531833B2

(12) United States Patent
Backs et al.

(10) Patent No.: US 6,531,833 B2
(45) Date of Patent: Mar. 11, 2003

(54) SINGLE BALLAST FOR POWERING AT LEAST ONE HIGH INTENSITY DISCHARGE LAMP

(75) Inventors: John Henry Backs, Hendersonville, NC (US); Byron Richard Collins, Tuxedo, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/770,745

(22) Filed: Jan. 25, 2001

(65) Prior Publication Data

US 2002/0140377 A1 Oct. 3, 2002

(51) Int. Cl.[7] ..... H05B 41/14

(52) U.S. Cl. ..... 315/290; 315/246; 315/276; 315/283; 315/291; 315/DIG. 2; 315/DIG. 5

(58) Field of Search ..... 315/290, 56, 57, 315/200 R, 224, 246, 248, 267, 276, 282, 283, 287, 291, 307, DIG. 2, DIG. 5, DIG. 7

(56) References Cited

U.S. PATENT DOCUMENTS

| | | | | |
|---|---|---|---|---|
| 4,348,615 A | | 9/1982 | Garrison et al. | 315/219 |
| 4,958,107 A | | 9/1990 | Mattas et al. | 315/289 |
| 5,036,256 A | | 7/1991 | Garrison et al. | 315/308 |
| 5,051,665 A | | 9/1991 | Garrison et al. | 315/287 |
| 5,309,065 A | | 5/1994 | Nuckolls et al. | 315/205 |
| 5,449,980 A | | 9/1995 | Kiefer et al. | 315/240 |
| 5,572,093 A | * | 11/1996 | Kiefer | 315/209 CD |
| 5,635,800 A | | 6/1997 | Taubert | 315/175 |
| 6,034,489 A | | 3/2000 | Weng | 315/307 |

FOREIGN PATENT DOCUMENTS

| | | |
|---|---|---|
| EP | 93309965.7 | 1/1993 |
| WO | WO 93/17534 | 9/1993 |

* cited by examiner

*Primary Examiner*—Don Wong
*Assistant Examiner*—Thuy Vinh Tran
(74) *Attorney, Agent, or Firm*—Fay, Sharpe, Fagan, Minnich & McKee, LLP

(57) ABSTRACT

A discharge lamp circuit includes a power source for creating a current flow. A ballast is electrically connected to the power source and controls the current flow produced by the power source. A capacitor is electrically connected in the ballast. At least one discharge lamp is connected in series with the capacitor. The current flow passes through the discharge lamp during normal operation of the discharge lamp circuit. The ballast includes a switching circuit, electrically connected to the capacitor and the discharge lamp. The switching circuit provides an alternate path for the current flow during a starting operation of the discharge lamp circuit. The switching circuit provides the alternate path in accordance with a charge associated with the capacitor. The charge associated with the capacitor increases when the current flow passes through the alternate path.

21 Claims, 9 Drawing Sheets

SINGLE BALLAST FOR POWERING AT LEAST ONE HIGH INTENSITY DISCHARGE LAMP

BACKGROUND OF THE INVENTION

1. Field of the Invention

The present invention relates to ballasts for powering high pressure gas discharge lamps. It finds application in conjunction with a single ballast for starting/powering a single high pressure gas discharge lamp or a plurality of high pressure gas discharge lamps connected in series and will be described with particular reference thereto. In addition, the present invention will find application where any standard ballast finds application, particularly to gas discharge lamps.

2. Discussion of the Art

A high pressure discharge lamp, such as a metal halide, mercury, or high pressure sodium lamp, is typically powered by an electromagnetic ballast incorporating an iron core. The ballast receives voltage from a power source and outputs a ballast voltage for driving the lamp. The ballast, which uses an iron core and wire to achieve the necessary ballasting functions or current limiting functions represents a major component of ballast cost, as well as bulk.

The foregoing type of ballast typically powers only a single high pressure lamp. There is usually a correlation with lamp performance and the fill pressure of the arc tube. Higher arc tube fill pressures lead to improved lamp lumen depreciation (light output with time) but there is a corresponding increase in the voltage needed to start these lamps. One method that has been suggested to be used to accommodate a higher than normal fill pressure is to use a diode internal to the lamp in series with the starting electrode ballasting resistor. The diode serves to charge the capacitor on lead circuits—effectively increasing the open circuit voltage available to start the lamp. This method has been described for use as a retrofit for mercury ballasts which power Metal Halide lamps, as described, for example, in U.S. application Ser. No. 09/290,008, entitled Enhanced Lumen Maintenance of Metal Halide Lamps By Increased Cold Gas Fill, filed Apr. 9, 1999, and U.S. application Ser. No. 09/460,177, entitled Active Diode Protection Apparatus In Metal Halide Lamps, filed Dec. 10, 1999, both of which are assigned to the assignee of this application.

The present invention provides a new and improved apparatus and method which overcomes the problems of existing ballasts.

BRIEF SUMMARY OF THE INVENTION

A ballast for a discharge lamp is powered by an input power source and supplies an output load comprising at least one discharge lamp. A power capacitor, during operation, is electrically connected to both the power source and the at least one lamp. A switching circuit is electrically connected to the capacitor and the at least one lamp. A current created by the power source flows through the switching circuit, and by-passes the at least one lamp until a voltage on the capacitor is sufficient to start the lamp. Under normal operation current flows through the switching circuit at least until the charge on the capacitor is sufficient to start the at least one discharge lamp. In certain situations, the voltage may reach a maximum voltage which is not sufficient to start the lamp.

By the foregoing design more voltage is delivered to start the lamps than that delivered in previous designs, and requires less material, is cheaper to manufacture, and has a lower operating cost than previous designs.

DETAILED DESCRIPTION OF THE INVENTION

Figure 1:
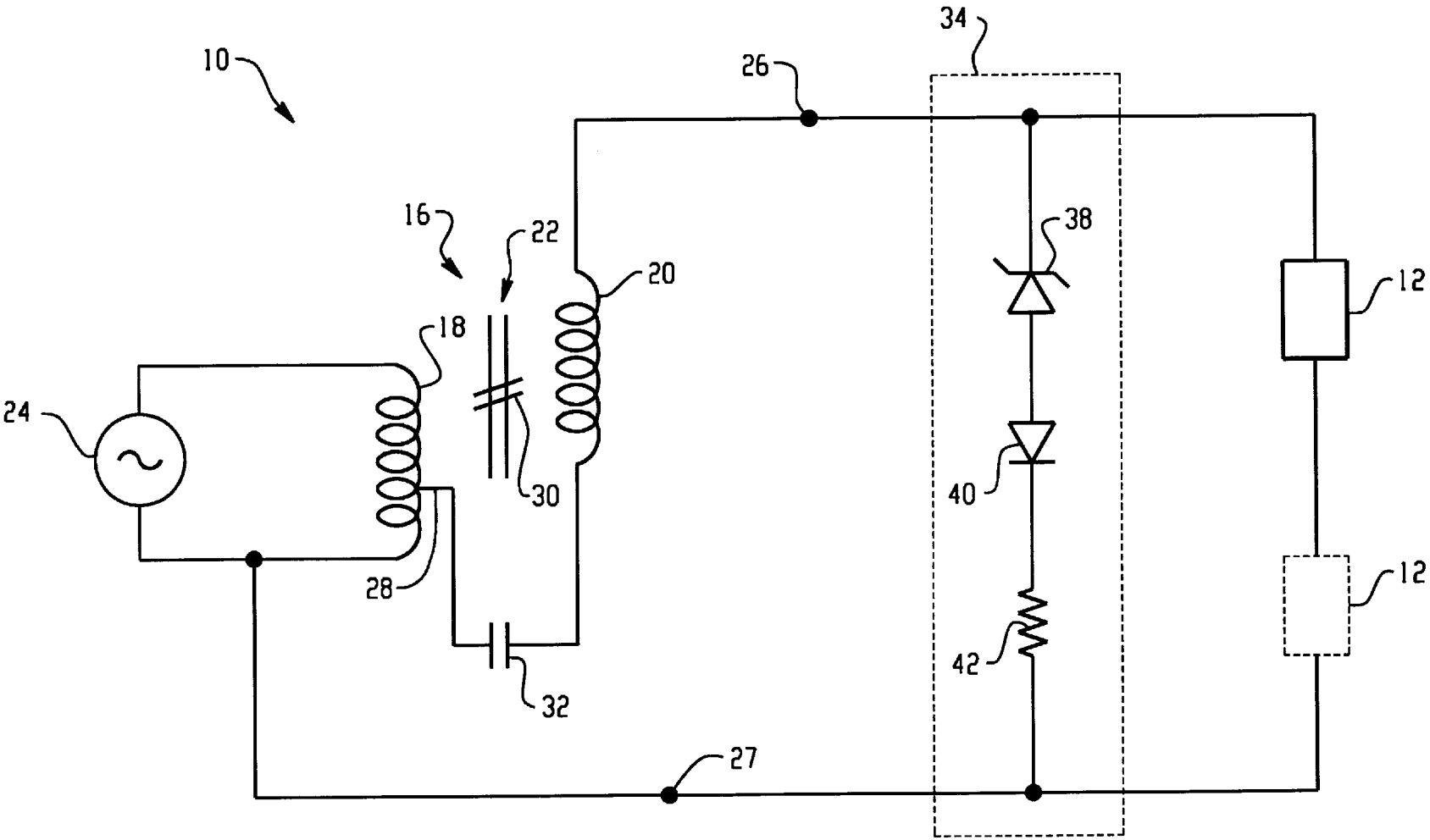
FIG. 1 illustrates a schematic diagram of a single ballast circuit for powering at least one high pressure discharge lamp, in accordance with the present invention.

FIG. 1 illustrates a ballast 10 for powering an output load such as high pressure discharge lamps 12, 14, which are connected in series. Lamp 14 is shown in dotted line to emphasize the present invention may be used to start a single lamp as well as multiple lamps. Ballast 10 is a constant-wattage auto-transformer (CWA) circuit. An electromagnetic ("e-m") component 16 such as for a lead ballast includes a primary winding 18, a secondary winding 20 and a magnetic core 22. The primary winding 18 receives an A.C. power signal from a source 24 and produces, as an output, a ballast voltage on secondary winding 20 with respect to a high side reference node 26 for driving the lamps 12, 14, where high side reference node 26 is on the high side of power source 24. A low side reference node 27 is shown on the low side of power source 24. To achieve the ballast voltage, the secondary winding 20 of the e-m component 16 is tapped into the primary winding 18 at point 28 while the primary and secondary windings 18, 20, respectively, are shunted as indicated by diagonal lines representing a magnetic element 30. A ballast capacitor 32 acts as a power capacitor for producing a desired phase angle between current and voltage supplied by the power source 24, and, in combination with the e-m component 16, limits current to the lamps 12, 14.

Although the e-m component 16, is disclosed as part of a lead ballast circuit, it is to be understood that other e-m components are also contemplated. For example, it is also contemplated that the e-m component may be a reactor, or a two coil device with an isolated secondary winding (such as a CWI ballast). Any e-m component chosen, however, must provide a suitable ballast performance for driving the lamps 12, 14 as part of a lead ballast circuit.

Ballast 10 includes a switching circuit 34, electrically connected between the high and low sides of the power source 24. In the preferred embodiment, the switching circuit 34 includes a zener diode 38, a diode 40, and a resistor 42. The components 38, 40, 42 forming the switching circuit 34 are connected in series with one another and in parallel with the lamps 12, 14. Zener diode 38 and resistor 42 may be considered current regulation devices. Components 38, 40 and 42 can be attached in an order other than as shown in FIG. 1.

When it is desirable to start the lamps 12, 14, power is supplied from the alternating power source 24. During one set of half-cycles (e.g., the "positive" half-cycles), the zener diode 38, the diode 40, and the resistor 42 allow current to flow from the power source 24, through the primary and secondary windings 18, 20, respectively, the power capacitor 32, and switching circuit 34. The diode 40 only allows the current to flow in one direction. Therefore, the power capacitor 32 is charged during the positive half-cycles, but is not discharged during the "negative" half-cycles. A charge is added to the power capacitor 32 each time the current flows through the switching circuit 34 (i.e., the charge on the power capacitor 32 is cumulative). The diode 40 is rated at least high enough to block the open-circuit voltage ("OCV") of the em component 16 and the power capacitor 32.

The zener diode 38 acts as a switch, causing the switching circuit 34 to act as an alternate path for the current as long as the voltage across the lamps 12, 14 is not sufficient to start the lamps and the capacitor voltage has not reached a desired value. Once the lamps 12, 14 start, the zener diode 38 prevents current from passing through the switching circuit 34 (because the operating voltage of the lamp(s) is lower than the OCV). Therefore, the value of the zener diode 38 is chosen such that the voltage of the power capacitor 32 continues to increase during the alternating half-cycles until it reaches a level sufficient to start the lamps 12, 14. In this manner, the OCV of the circuit is increased until it is sufficient to start the lamps 12, 14.

Because power capacitor 32 serves the function of a series power capacitor during normal operation, it is capable of storing a large quantity of energy for starting the lamps 12, 14. This is a reason the present invention is capable of providing more energy to start lamps 12 and 14 than previous designs. Designing ballast circuit 10 so that power capacitor 32 is in cooperation with the switching circuit 34 gives the power capacitor 32 a dual purpose, and hence reduces the number of parts in the preferred embodiment of the present invention.

Regulator 42 regulates the amount of current which passes through the switching circuit 34 during the positive half-cycles. Excessive current causes increased component costs. Too little current, on the other hand, increases the number of half-cycles used to sufficiently charge the power capacitor 32, thereby delaying the time required to start the lamps 12, 14.

While the preferred embodiment has been described as incorporating a diode, a zener diode, and a resistor, it is to be understood that other embodiments, which incorporate other components, are also contemplated. For example, it is contemplated to use other switching devices, such as sidacs and/or triacs, in place of the zener diode. Use of a switching device acts to prevent current from flowing through switching circuit 34 after lamps 12 and 14 have started, during normal operation of the lamps.

Figure 2:
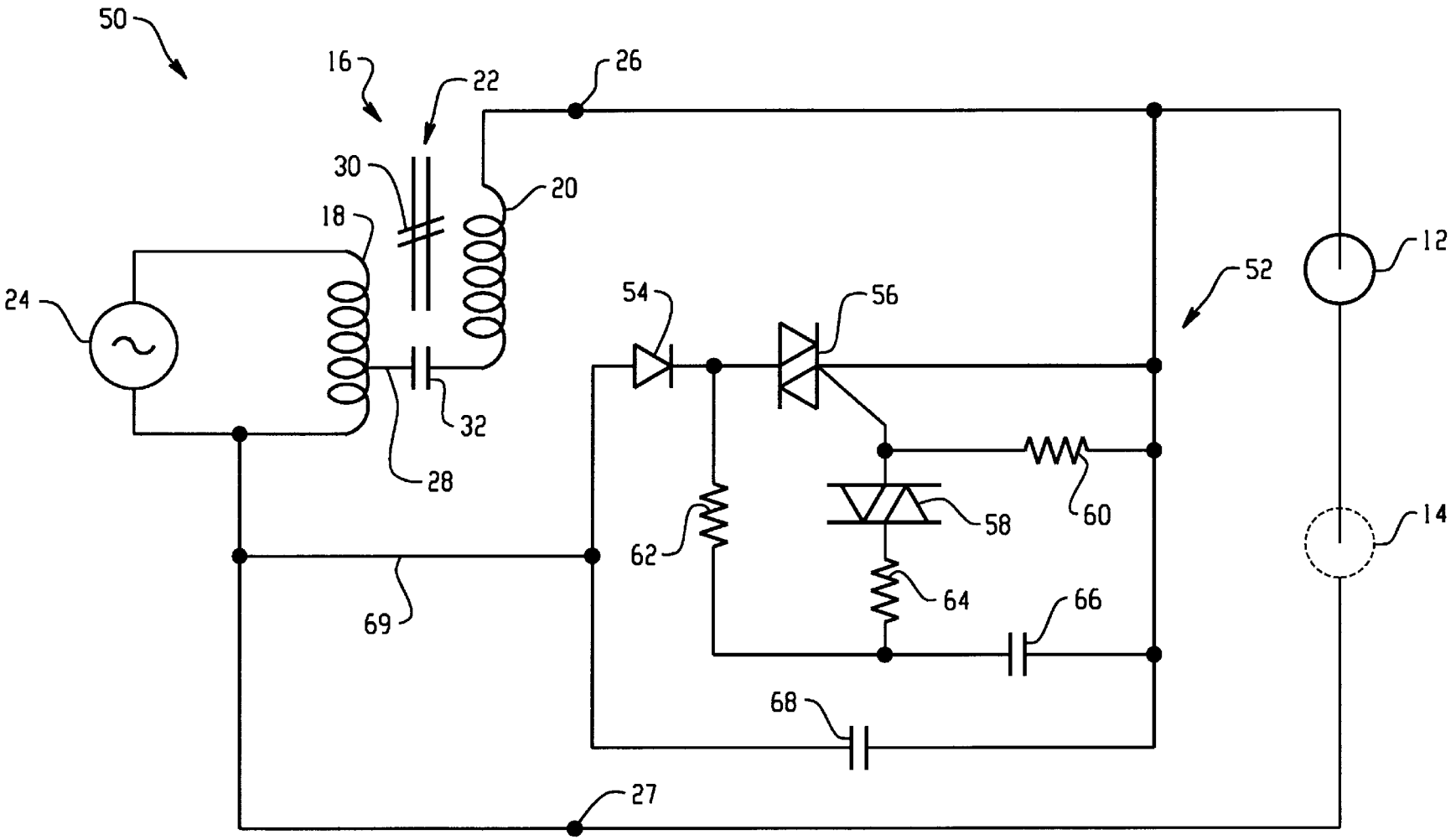
FIG. 2 illustrates a second embodiment of a ballast according to the teachings of the present invention.

For purposes of illustration, with reference to FIG. 2, another ballast circuit embodiment 50 of the present invention is depicted. With continuing reference to FIG. 1, like numbered numerals are for components serving similar purposes. Switching circuit 52 replaces switching circuit 34 for the embodiment depicted in FIG. 2 wherein switching circuit 52 comprises diode 54, triac 56, sidac 58, resistors 60, 62 and 64, and capacitors 66 and 68. This particular embodiment is exemplary of embodiments employing triacs as the switching devices such as triac 56 in this exemplary embodiment. A connection line 69 is shown connecting one side of diode 54 and one side of capacitor 68 to the low side of power source 24.

Figure 3:
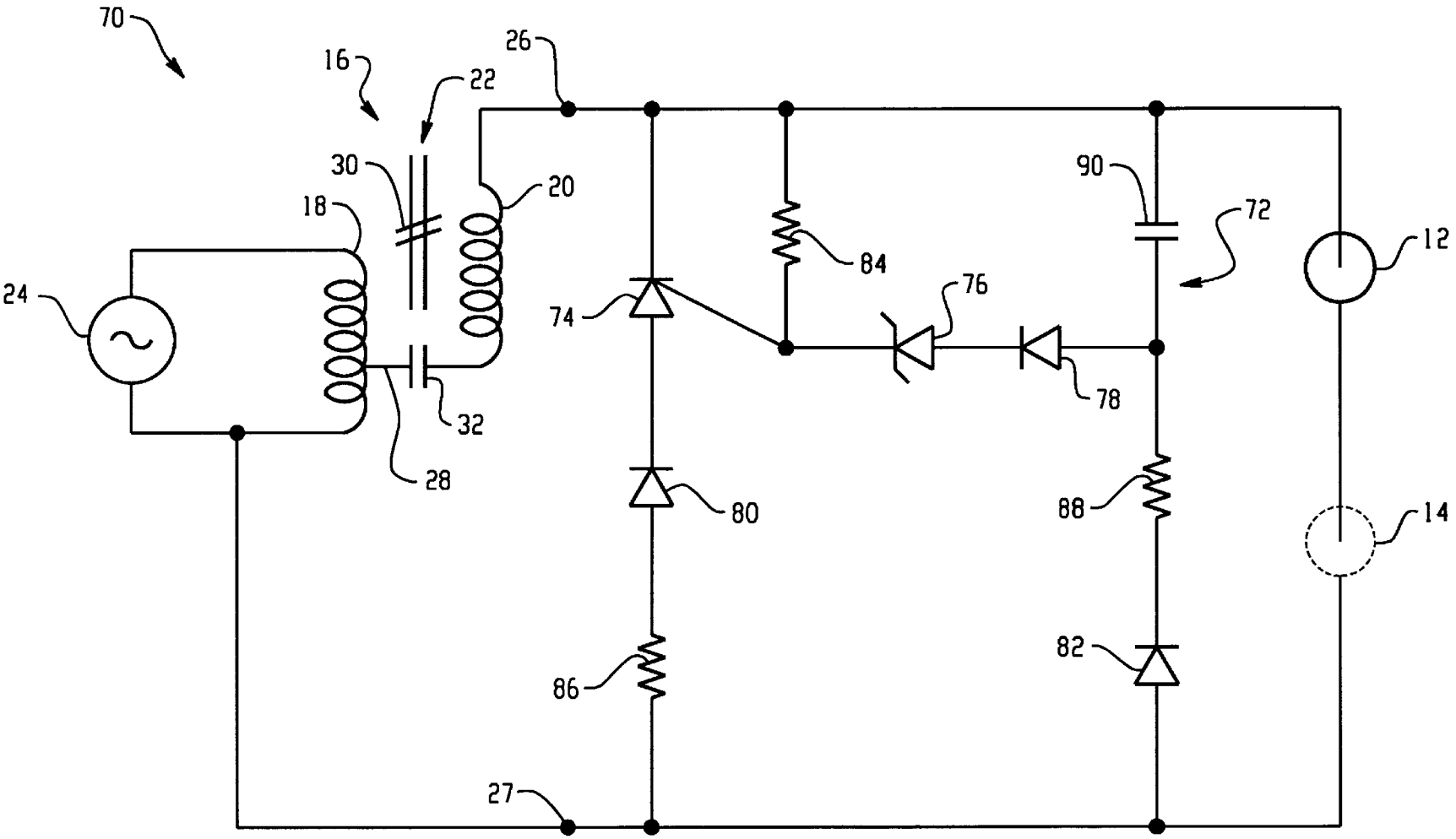
FIG. 3 depicts a third embodiment of the ballast according to the present invention.

Another exemplary embodiment of the present invention, utilizing an SCR as the switching device, is depicted in FIG. 3 as ballast circuit 70. As with the aforementioned exemplary embodiment, like numbered numerals are used for components serving similar purposes. Charging circuit 72 comprises SCR 74, zener diode 76, diodes 78, 80 and 82, resistors 84, 86 and 88, and capacitor 90 wherein SCR 74 comprises the switching device.

Figure 4:
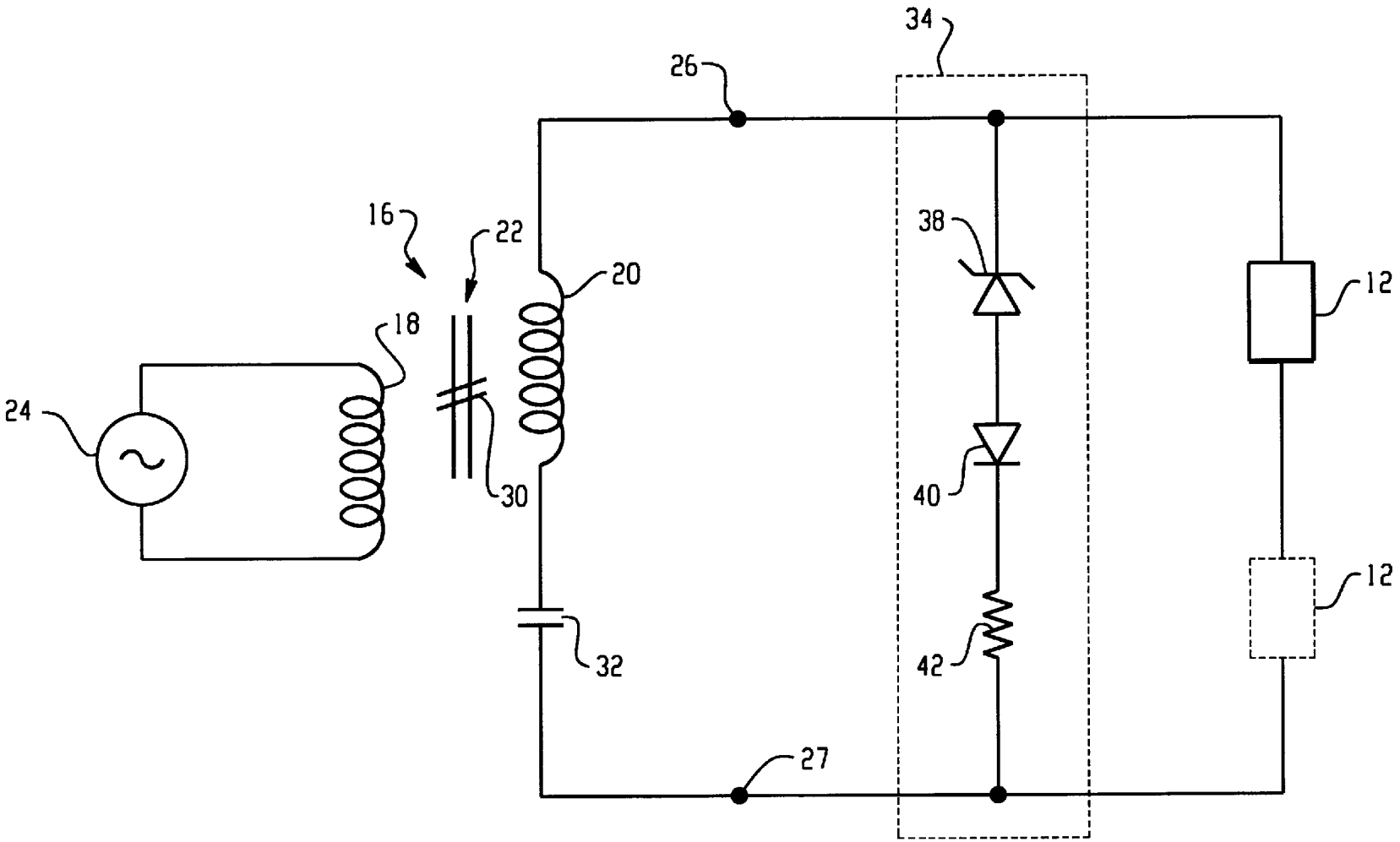
FIG. 4 sets forth an embodiment for the present invention implementing a CWI ballast arrangement.

In FIG. 4, an alternative ballast arrangement in connection with the present invention is illustrated. Particularly, while FIG. 1 sets forth a circuit with a constant wattage autotransformer (CWA), FIG. 4 depicts the present invention implemented with a constant wattage isolated-transformer (CWI), where first winding 18 and second winding 20 are isolated from each other, with coil 20 and capacitor 32 tied directly to reference node 27. Since bottom node 27 does not return to primary winding 18, isolation exists between transformer windings 18 and 20. It is understood the CWI may be used with the other described embodiments.

Figure 5:
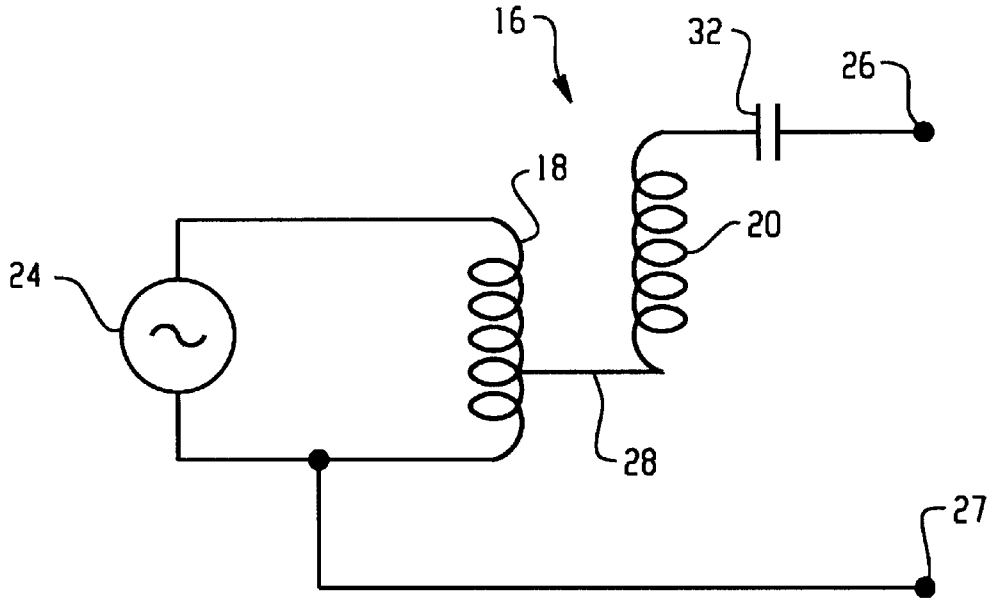
FIG. 5 depicts a further embodiment showing the relationship between the ballast capacitor and the coils of the E-M component.

FIG. 5 is provided as an alternative embodiment regarding the interconnection between capacitor 32 and the primary winding 18 and secondary winding 20 of e-m component 16. Particularly, this input portion may be implemented in place of the circuitry shown in FIGS. 1, 2 and 3 extending from nodes 26 and 27. Thus, everything to the left side of nodes 26 and 27 in FIGS. 1, 2 and 3 would be replaced with the circuitry shown in FIG. 5. This provides optional connections for the present invention.

Figure 6:
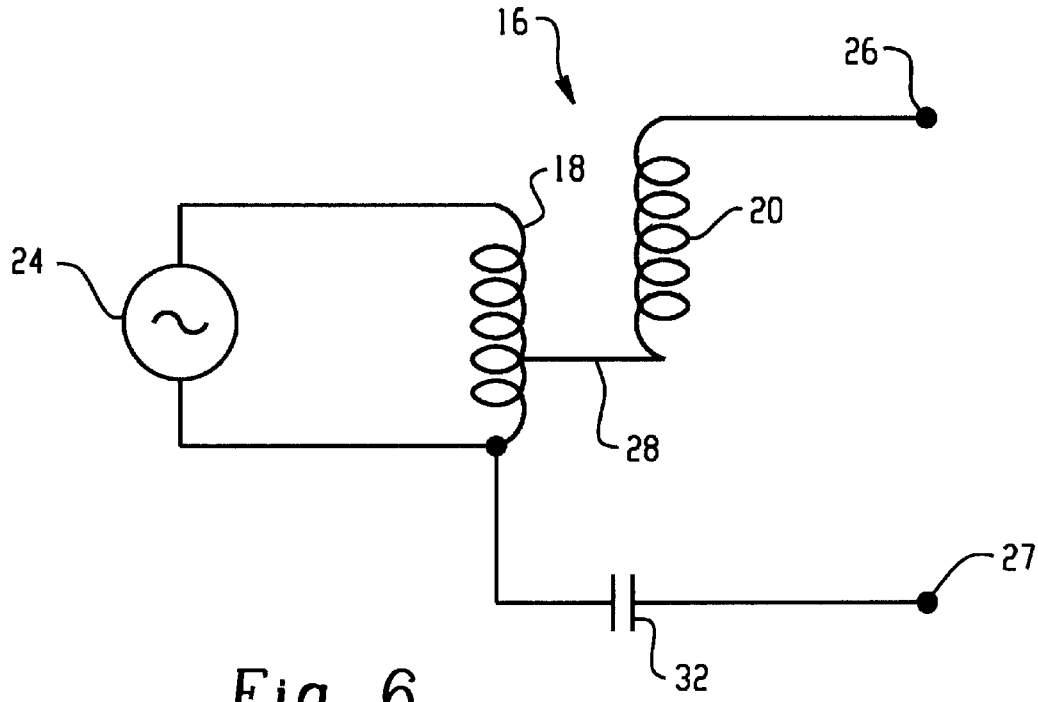
FIG. 6 depicts yet another configuration between the ballast capacitor and the first and second windings of the E-M component according to the present invention.

FIG. 6 depicts a further input connection arrangement for capacitor 32 in relationship to primary winding 18 and secondary winding 20 of e-m component 16. Similar to FIG. 4, the winding arrangement shown in FIG. 5 may be used in place of the input design used in FIGS. 1, 2 and 3.

Figure 7:
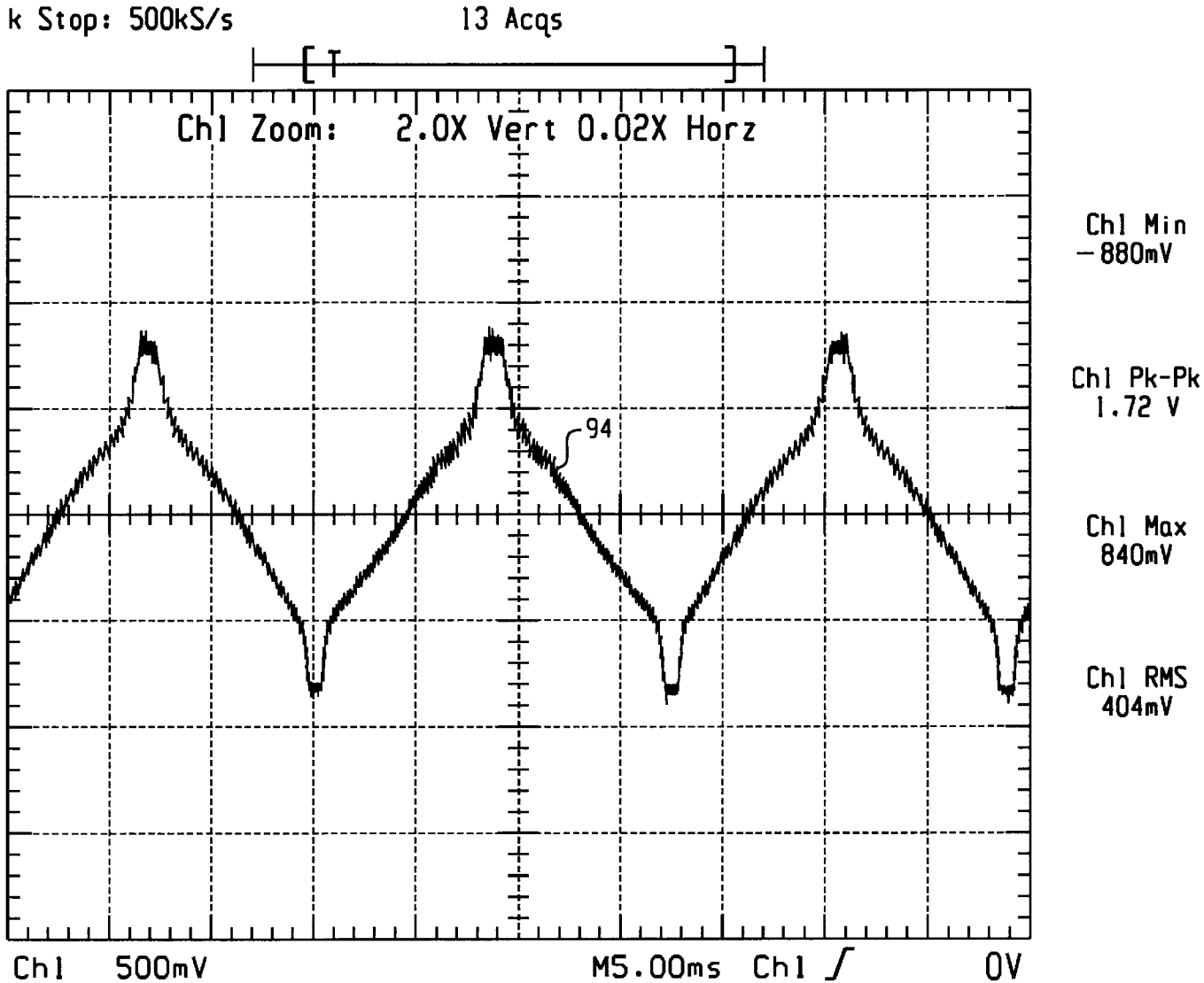
FIG. 7 is a plot of an open circuit voltage (OCV) for a ballast circuit which does not include a charging circuit according to the teachings of the present invention.
Figure 8:
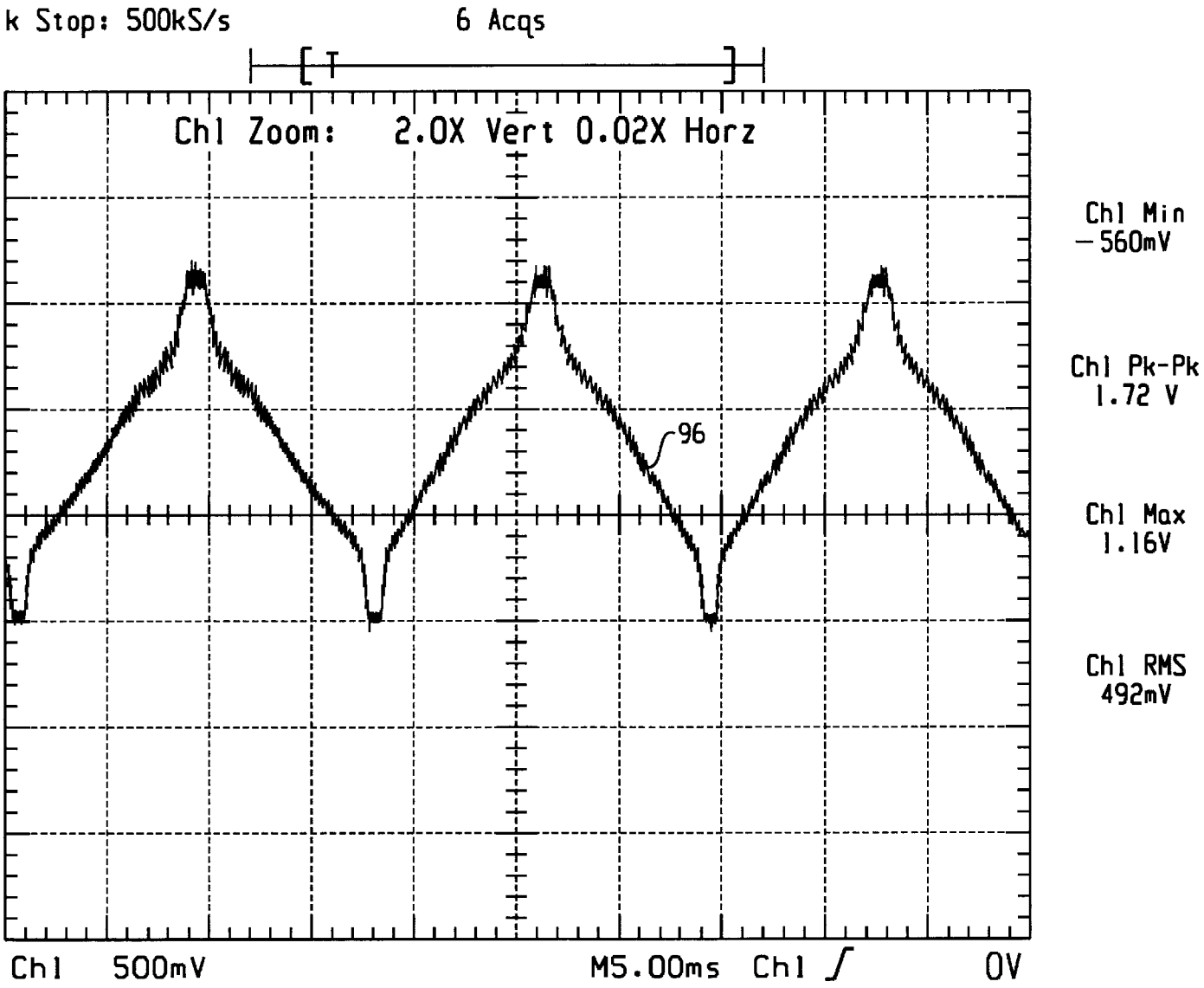
FIG. 8 is a plot depicting operation of a ballast utilizing a SCR device as a switching device.

FIG. 7 is a plot of the open circuit voltage 94 that a typical ballast circuit produces without a switching circuit such as any of switching circuits 34, 52 and 72, in other words, a circuit comprising only source 24, electromagnetic component 16 and power capacitor 32. To provide exemplary data proving the advantages of the present invention, the open circuit voltage 96 of ballast circuit 70, utilizing an SCR as the switching device, is plotted in FIG. 8. While the peak-to-peak voltage in FIGS. 7 and 8 are both about 1720 volts, a substantial dc component has been introduced in FIG. 8. In fact, the peak voltage has increased by approximately 320 volts from around 840 volts to 1160 volts, providing a significant additional starting voltage.

Figure 9:
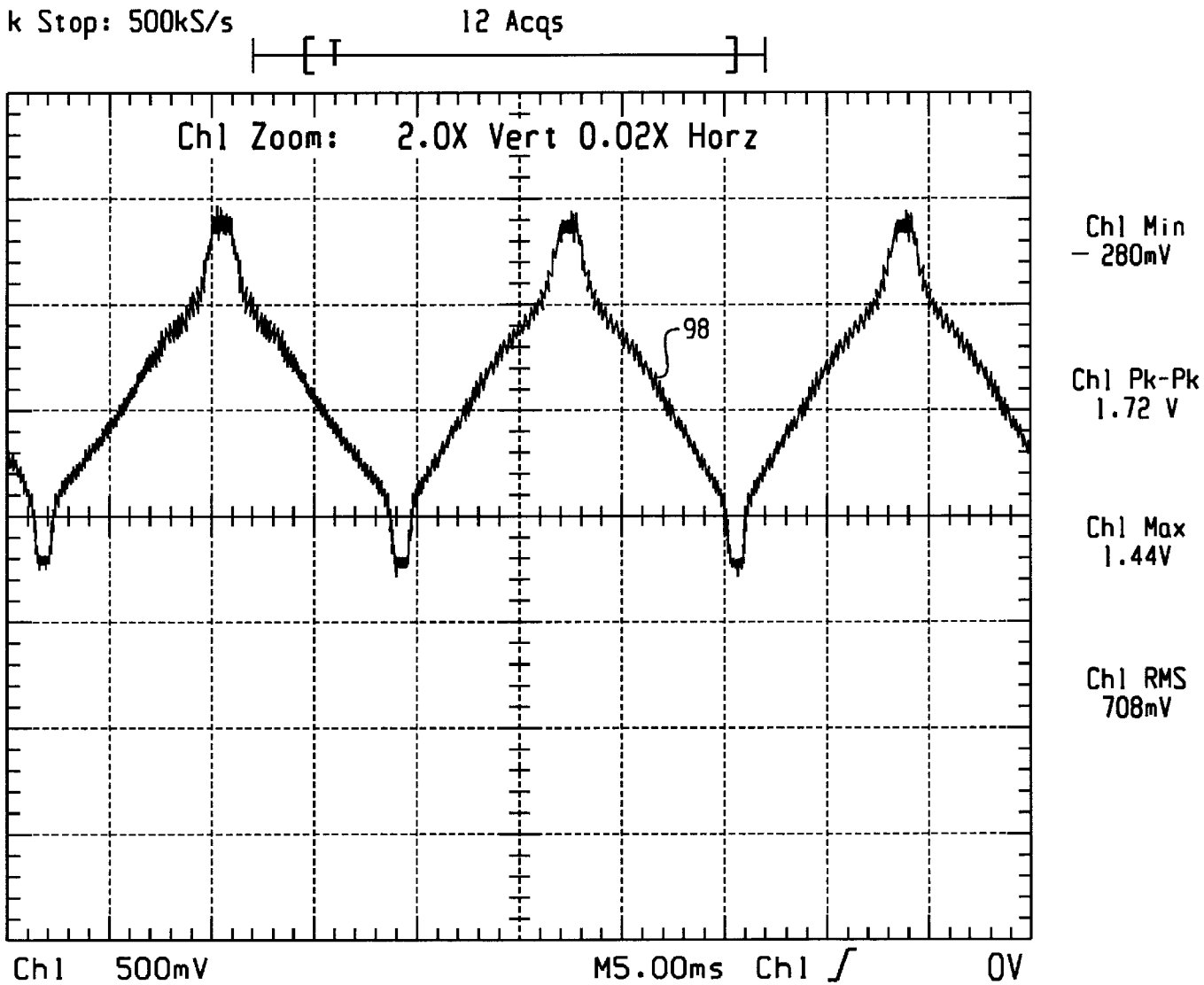
FIG. 9 is a plot of an open circuit voltage (OCV) for a ballast circuit utilizing a triac switching device.

FIG. 9 is a plot of the open circuit voltage 98 of ballast circuit 50, utilizing a triac as the switching device. Here again, the peak-to-peak voltage is about 1720 volts, however, an even more substantial dc component has been introduced when compared to FIG. 6. In FIG. 8, the peak voltage has increased by approximately 600 volts from around 840 volts to 1440 volts, nearly doubling the starting voltage.

Figure 10:
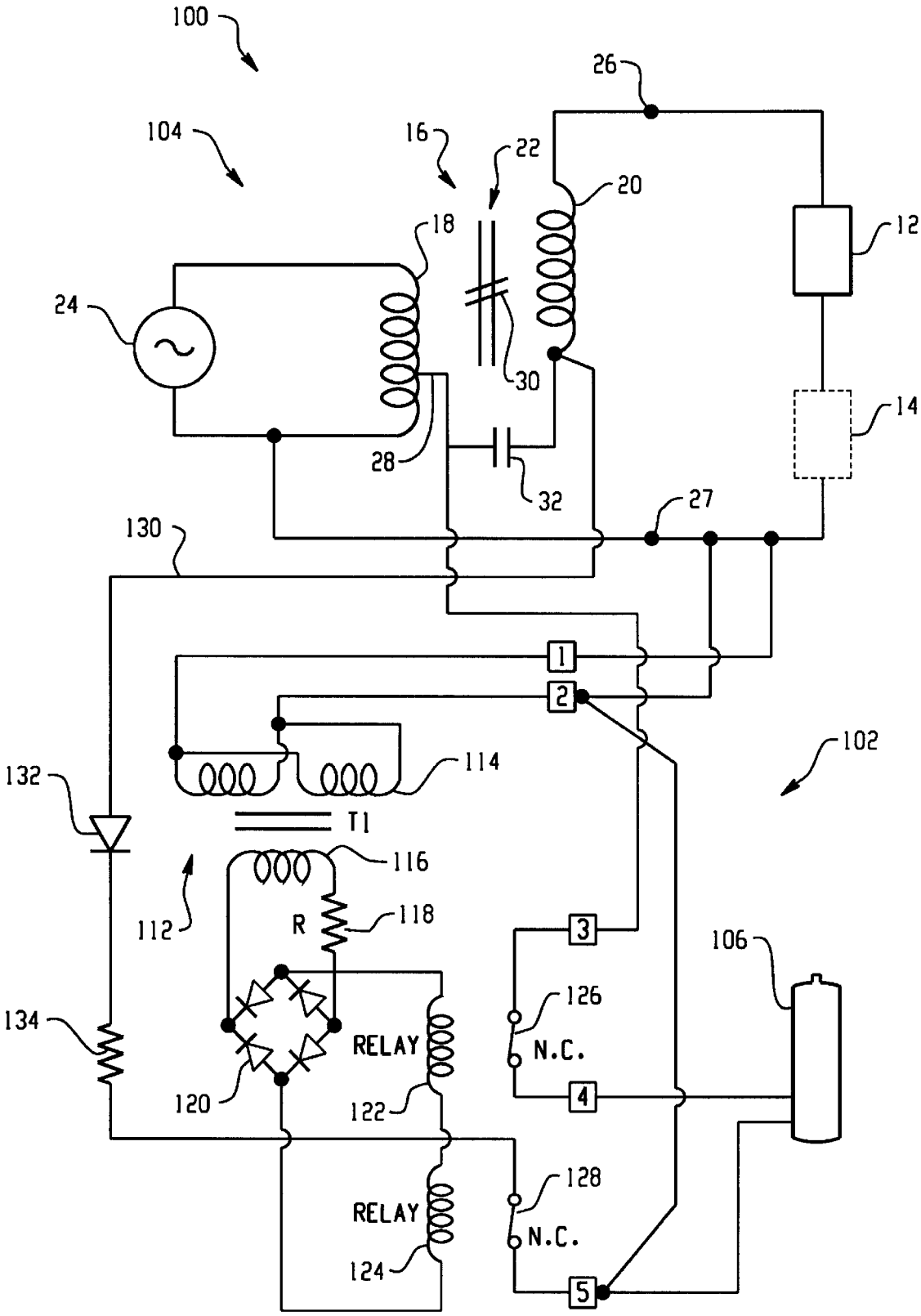
FIG. 10 illustrates a switch quartz circuit with a starting circuit implementing the concepts of the present invention.

FIG. 10 depicts a lighting circuit 100 which includes a "switch quartz" or stand-by circuit 102 used in combination with a HID lamp circuit 104, whereby the hot restart time of the HID lamp is reduced. Circuit 100 of FIG. 10 allows for the switch quartz circuit 102 to comply with governing ANSI standards and provides the potential to use higher wattage stand-by lamps 106, higher wattage HID lamps 12, 14, higher ambient temperatures, and a smaller optical element.

The components of circuit 104 have been previously discussed, therefore details of this operation will not be repeated. Switch quartz circuit 102 includes a transformer configuration 112 having a primary coil winding arrangement 114 and a secondary coil arrangement 116. A resistive diode bridge network consisting of resistor 118 and bridge 120 permits appropriate voltages to operate a relay coil 122 to control switch 126 which provides a path for operation of quartz lamp 106.

It is known that HID lamps take a considerable amount of time, up to 15 minutes or longer, to turn on after being de-energized. The switch quartz circuit 102 operates stand-by lamp 106 in situations where the HID light has been de-energized and has not yet turned back on. It is noted that for the HID lamp to again turn on, it must cool down past a certain temperature. The use of these stand-by lamps slow that cooling process as they restrict the cooling rate of the HID lamp. Therefore restrictions on the wattage of the stand-by lamps are a major consideration. For example, a 400-watt HID lamp may be allowed to only use one 50-watt quartz lamp, since if the wattage is too high on the stand-by lamp, the restart time will be extended or the lamp may not be able to start at all.

In circuit 100 when the HID lamp is off (12 or 14) but power is still being supplied to the circuit, the stand-by lamp 106 will be turned on. When the HID lamp 12, 14 turns on, then the stand-by lamp is turned off.

By adding connection wire 130 along with diode 132 and resistor 134, additional voltage is obtained. Use of components 132 and 134 allows for increasing the voltage across lamps 12, 14 which assists in starting the HID lamps 12, 14 faster, as well as the possibility of using a higher wattage incandescent lamp for stand-by lamp 106.

Thus, a voltage doubling procedure is provided in connection with an HID lamp and stand-by lamp combination by adding diode 132 and resistor 134, and a second relay coil 124 and switch 128 to a switch quartz circuit 102. As long as the stand-by lamp is on, capacitor 32 is charged through diode 132 and the resistor 134 so that the OCV that appears across the HID lamps 12, 14 is raised. As soon as the HID lamp starts, the diode and resistor circuit is automatically disconnected.

FIG. 10 therefore shows the addition of a voltage doubling circuit to the switch quartz circuit that connects the output of the series capacitor to ground through a diode and resistor. Alternatively, a full wave bridge and resistor could be used. This doubling circuit is enabled or connected whenever the HID lamp is off, but output voltage is available from the ballast. The circuit disconnects the voltage doubler as soon as the HID lamp turns on. The same signal that is used to turn off the switch quartz lamp can be used for these purposes.

Exemplary component values and/or designations for the circuit of FIG. 2 are as follows for a source 24 voltage of 277 volts and with 400 watt metal halide lamps for lamps 12 and 14:

| | |
|---|---|
| Capacitor 32 | 18 micro farads |
| Sidac 58 | 540 V |
| Resistor 60 | 100 ohms |

-continued

| | |
|---|---|
| Resistor 62 | 47 kohms |
| Resistor 64 | 10 ohms |
| Capacitor 66 | 0.47 micro farads |
| Capacitor 68 | 15 pico farads |

Additionally, e-m component 16 is sold under the designation 35-207804-68, diode 54 under the designation 1N4007, and triac 56 under the designation MAC223.

Exemplary component values and/or designations for the circuit of FIG. 3 are as follows for a source 24 voltage of 277 volts and with 400 watt metal halide lamps for lamps 12 and 14:

| | |
|---|---|
| Resistor 84 | 1 megohm |
| Resistor 86 | 300 ohms |
| Resistor 88 | 32 kohms |
| Capacitor 90 | 0.33 micro farads |

Additionally, e-m component 16 is sold under the designation 35-207804-68, SCR 74 under the designation MCR70-6A, zener diode 76 under the designation TVS 1.5KE150, diodes 78 and 82 under the designation 1N4007, and blocking diode 80 under the designation GI758.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A ballast powered by a power source, for regulating operation of at least one discharge lamp, the ballast comprising:

an e-m component having a magnetically coupled primary winding and secondary winding, the primary winding further connected across the power source, and generating a ballast voltage;

a capacitor electrically connected at a first end to the secondary winding, and at a second end to at least one of the primary winding and a reference bus, the capacitor configured for two modes of operation, a first mode as a power capacitor for producing a desired phase angle between current and voltage supplied by the power source, and a second mode to provide capacitor voltage in combination with the ballast voltage sufficient to start the at least one discharge lamp; and a switching circuit operationally connected to the capacitor, wherein the switching circuit is configured for connection across the at least one discharge lamp, a current created by the power source by-passing the switching circuit, as a function of a voltage on the capacitor, the voltage on the capacitor increasing when the current flows through the ballast, the current flowing through the ballast at least until the combined voltage on the capacitor and the ballast voltage is sufficient to start the at least one discharge lamp.

2. The ballast as set forth in claim 1, wherein the switching circuit comprises:

a first diode electrically connected to the power source; and a resistor electrically connected to the first diode and the power source.

3. The ballast as set forth in claim 2, wherein the switching circuit further comprises:

a second diode electrically connected to the power source, the first diode, and the resistor.

4. The ballast as set forth in claim 3, wherein the second diode permits current to flow when the voltage on the capacitor is below a desired value for starting the at least one lamp.

5. The ballast as set forth in claim 4, wherein the second diode is a zener diode.

6. The ballast as set forth in claim 3, wherein:

the current produced by the power source is an alternating-current including a positive half-cycle and a negative half-cycle; and the first diode permits current produced during one of the positive half-cycle and the negative half-cycle to charge the capacitor and prevents voltage produced during the other of the positive half-cycle and the negative half-cycle from discharging the capacitor.

7. The ballast as set forth in claim 1, wherein the at least one lamp is a high pressure discharge lamp.

8. The ballast according to claim 1 further including a stand-by lamp circuit having the switching circuit and stand-by lamp, wherein the stand-by lamp is active when power is supplied to the discharge lamp circuit and the discharge lamp is inactive.

9. A discharge lamp circuit powered by a power source for creating current flow including a positive half-cycle and a negative half-cycle, the discharge circuit comprising:

a ballast, having an e-m component, connected to the power source, the ballast generating a ballast voltage;

a capacitor configured to electrically receive power from the power source and to be connected in series with at least one discharge lamp, the current flow passing through the discharge lamp during a normal operation of the discharge lamp circuit; and a switching circuit including:

a switching device, electrically connected to the capacitor and configured for connection to the discharge lamp, to provide an alternate path for the current flow during a starting operation of the discharge lamp circuit, the switching device providing the alternate path in accordance with a voltage associated with the capacitor, the voltage associated with the capacitor increasing when the current flow passes through the alternate path, by a charging of the capacitor during one of the positive half-cycle and the negative half-cycle, the discharge lamp circuit configured to prevent current produced during the other of the positive half-cycle and negative half-cycle from discharging the capacitor, the alternative path being provided when the combined voltage on the capacitor and the ballast voltage is below a value necessary for starting the at least one discharge lamp, and when the voltage on the capacitor and the ballast voltage is above the value necessary for starting the at least one discharge lamp, the capacitor voltage and the ballast voltage are provided to the at least one discharge lamp; and a regulator for controlling the current flow through the alternate path.

10. The discharge lamp circuit as set forth in claim 9, wherein the switching circuit includes:

a first diode, electrically connected to the switching device, for allowing the current flow through the alternate path and the regulator in only a single direction; and the regulator including at least a resistor, for limiting an amount of the current flow through the alternate path.

11. The discharge lamp circuit as set forth in claim 10, wherein the switching device comprises a zener diode.

12. The discharge lamp circuit as set forth in claim 10, wherein:

the first diode allows current produced during the one of the positive half-cycle and the negative half-cycle to charge the capacitor and prevents current produced during the other of the positive half-cycle and the negative half-cycle from discharging the capacitor.

13. The discharge lamp circuit as set forth in claim 9, wherein the at lease one discharge lamp is a high pressure discharge lamp.

14. The discharge lamp circuit according to claim 9 further comprising a stand-by lamp circuit having the switching circuit and a stand-by lamp, wherein the stand-by lamp is active when power is supplied to the discharge lamp circuit and the discharge lamp is inactive.

15. A method for starting at least one discharge lamp powered by a ballast including a ballast capacitor which is connected in series with the at least one discharge lamp, the method comprising:

operating the ballast capacitor in two modes, in a first mode, building-up a charge on the ballast capacitor to a final charge which is sufficient to start the at least one discharge lamp, and in a second mode using the ballast capacitor during a normal operation to provide a desired phase angle between current and voltage supplied by the power source to the at least one discharge lamp; and delivering the sufficient voltage to the at least one discharge lamp, thereby starting the discharge lamp.

16. The method for starting at least one discharge lamp as set forth in claim 15, wherein the step of building-up comprises:

causing a current flow created by a power source to flow through an alternate path, thereby by-passing the at least one discharge lamp.

17. The method for starting at least one discharge lamp as set forth in claim 16, wherein the power source produces an alternating current flow, the step of building-up further comprises:

during alternate half-cycles of the alternating current flow, allowing the alternating current flow to build-up the charge on the ballast capacitor to the final charge; and preventing the alternating current flow from discharging the ballast capacitor during the other of the alternate half-cycles of the alternating current flow.

18. The method for starting at least one discharge lamp as set forth in claim 17, wherein the step of building-up further comprises:

limiting an amount of the alternating current flow through the alternate path.

19. The method for starting at least one discharge lamp as set forth in claim 18, wherein the step of building-up further comprises:

when the charge on the ballast capacitor reaches the final charge, preventing the current flow from by-passing the at least one discharge lamp.

20. The method for starting at least one discharge lamp as set forth in claim 15, wherein the step of delivering includes:

passing the alternating current flow through the at least one discharge lamp.

21. The method for starting the at least one discharge lamp as set forth in claim 15, further comprising, activating a stand-by lamp circuit having a switching circuit and a stand-by lamp, when power is supplied to the discharge lamp circuit and the discharge lamp is inactive.

* * * * *